United States Patent [19]

Smedlund

[11] 4,241,652

[45] Dec. 30, 1980

[54] DEVICE FOR OBTAINING COORDINATED MOVEMENTS OF OPERATIVE MEMBERS INCORPORATED IN A MACHINE OR A PLANT

[76] Inventor: Kurt H. Smedlund, Karl XI väg 45B, Halmstad, Sweden, 301 02

[21] Appl. No.: 874,334

[22] Filed: Feb. 1, 1978

[30] Foreign Application Priority Data

Feb. 10, 1977 [SE] Sweden ..... 7701475

[51] Int. Cl.[2] ..... B30B 15/14

[52] U.S. Cl. ..... 100/49; 53/527; 74/89.15; 100/52; 100/215; 100/223; 100/289

[58] Field of Search ..... 100/52, 289, 223, 256, 100/49, 53, 215, 221; 53/124 B, 527; 74/89.15

[56] References Cited

U.S. PATENT DOCUMENTS

| | | | |
|---|---|---|---|
| 791,746 | 6/1905 | Barngrover | 100/221 |
| 2,205,133 | 6/1940 | Bragg | 100/223 X |
| 2,984,957 | 5/1961 | Lundgren | 100/223 X |
| 3,184,214 | 5/1965 | King | 74/89.15 X |
| 3,531,909 | 10/1970 | Edelbalk | 100/223 X |

*Primary Examiner*—Billy J. Wilhite

*Attorney, Agent, or Firm*—Newton, Hopkins & Ormsby

[57] ABSTRACT

Plural refuse receivers on an indexable support are positioned in succession below the outlet of a refuse delivery chute. A refuse compacting member is held in a neutral position between two adjacent receivers while refuse is being delivered into each receiver from the chute. During the indexing of the support carrying the refuse receivers and while the support is at a dwell, the compacting member is driven downwardly to act on refuse in one receiver and is then elevated above the receivers prior to the next indexing, all by the operation of a simplified power-operated movement programming mechanism.

8 Claims, 6 Drawing Figures

3
5
20
18
33
21
19
25
31
22
26
32
30
35
29
24
23
36
34
II
1
17
II
27
16
(8)
13
10
10
6
26
28
7
9
12
19
2
4
11

DEVICE FOR OBTAINING COORDINATED MOVEMENTS OF OPERATIVE MEMBERS INCORPORATED IN A MACHINE OR A PLANT

BACKGROUND OF THE INVENTION

The present invention concerns a device designed to bring about coordination of the movements of operative members incorporated in a machine or a plant, wherein the displacement of each individual member from one position to the next to perform a working operation depends on the displacement of one or several of the other operative members.

Such coordination of the movements of various operative members is essential in many machines designed to manufacture products of various kinds, to package products in wrapping or to transport them to various stations in a machine. Usually such machines include a programming mechanism of some kind which by mechanic, pneumatic, hydraulic or electric means ensures that the correct operative members carry out their working operations in the correct time sequence and to the exact extent.

A common feature in all prior-art machines is that the programming mechanisms included therein inevitably become extremely complicated when the number of operative members included rises and their movement patterns are becoming more complex. As a result, the machines become considerably more expensive to manufacture while at the same time their operation reliability often drops, thus increasing the risk of operational shut-downs.

SUMMARY OF THE INVENTION

The subject invention provides a device which uses comparatively simple mechanical means to give the desired coordination between several operative members included in a machine or in a plant and wherein such coordination is obtained completely automatically whithout any need for complicated control means.

The invention is essentially characterised by the provision of a rotatable sleeve which is connected to at least one first operative member and is provided with internal guide tracks forming curves in accordance with a predetermined programming pattern, and by a non-rotatable, elongated body which likewise is connected to at least one second operative member and is axially displaceable inside the sleeve and provided with a transversely projecting guide pin, said elongated body arranged, upon its displacement in one direction for the purpose of causing its associated operative member to effect a working operation and by the sliding movement of its guide pin in one of said guide tracks, to bring the sleeve and consequently also the operative member connected thereto to turn in conformity with the curvature of said guide track to the desired position in relation to the second operative member.

Preferably, the elongated body consists of an inner sleeve which is arranged for movement inside the first sleeve and provided with internal threads, said inner sleeve mounted for axial movement on a rotationally arranged threaded spindle.

BRIEF DESCRIPTION OF THE DRAWINGS

The invention will be described in closer detail in the following with reference to the accompanying, partly diagrammatical drawings illustrating one example of practical application of the invention in a rotatable stand designed to hold several garbage bags and including a compacting means design to compress the garbage inside the bags.

In the drawings.

DETAILED DESCRIPTION OF A PREFERRED EMBODIMENT

Figure 1:
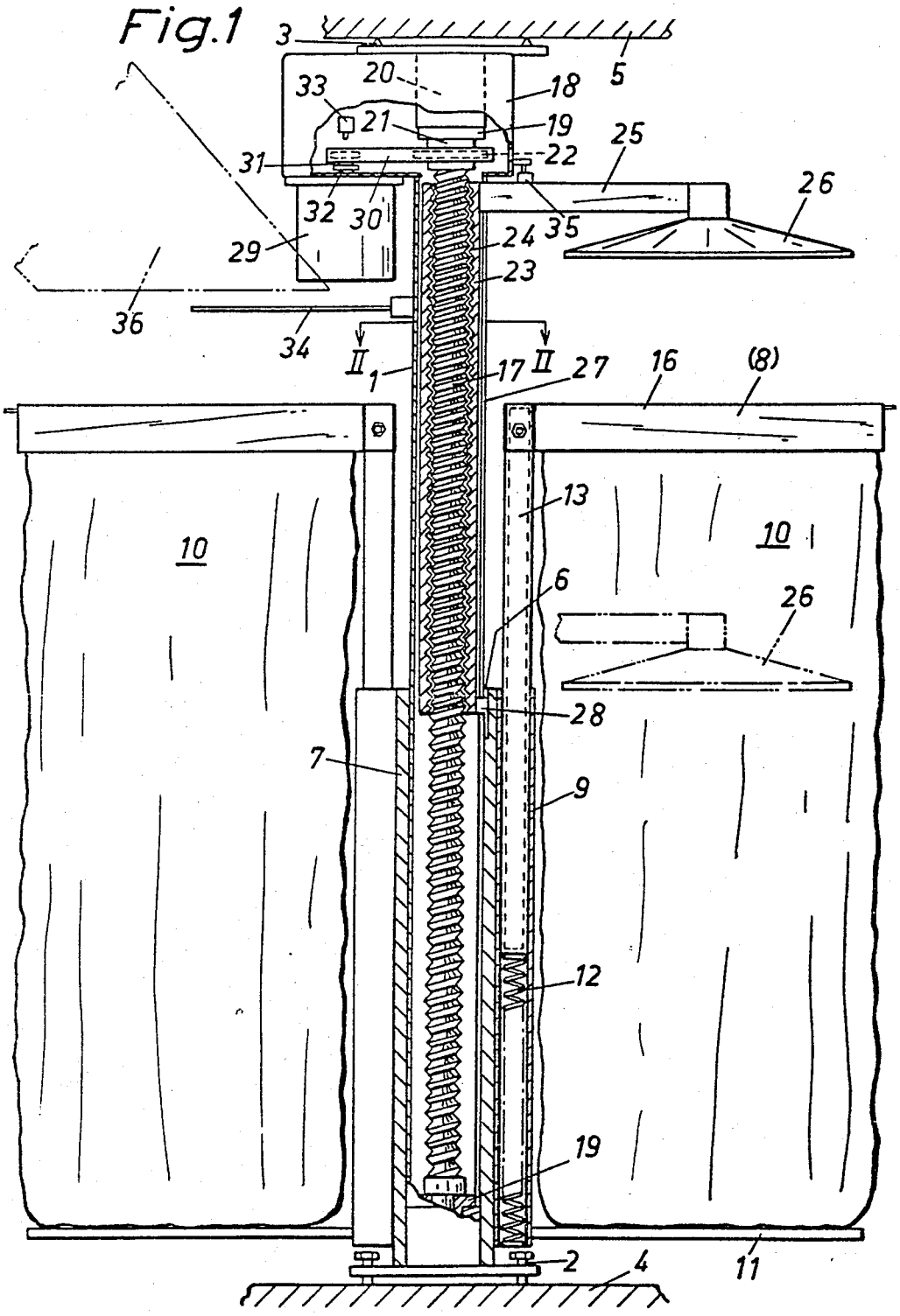
FIG. 1 illustrates the device in accordance with the invention in a broken, lateral view.
Figure 2:
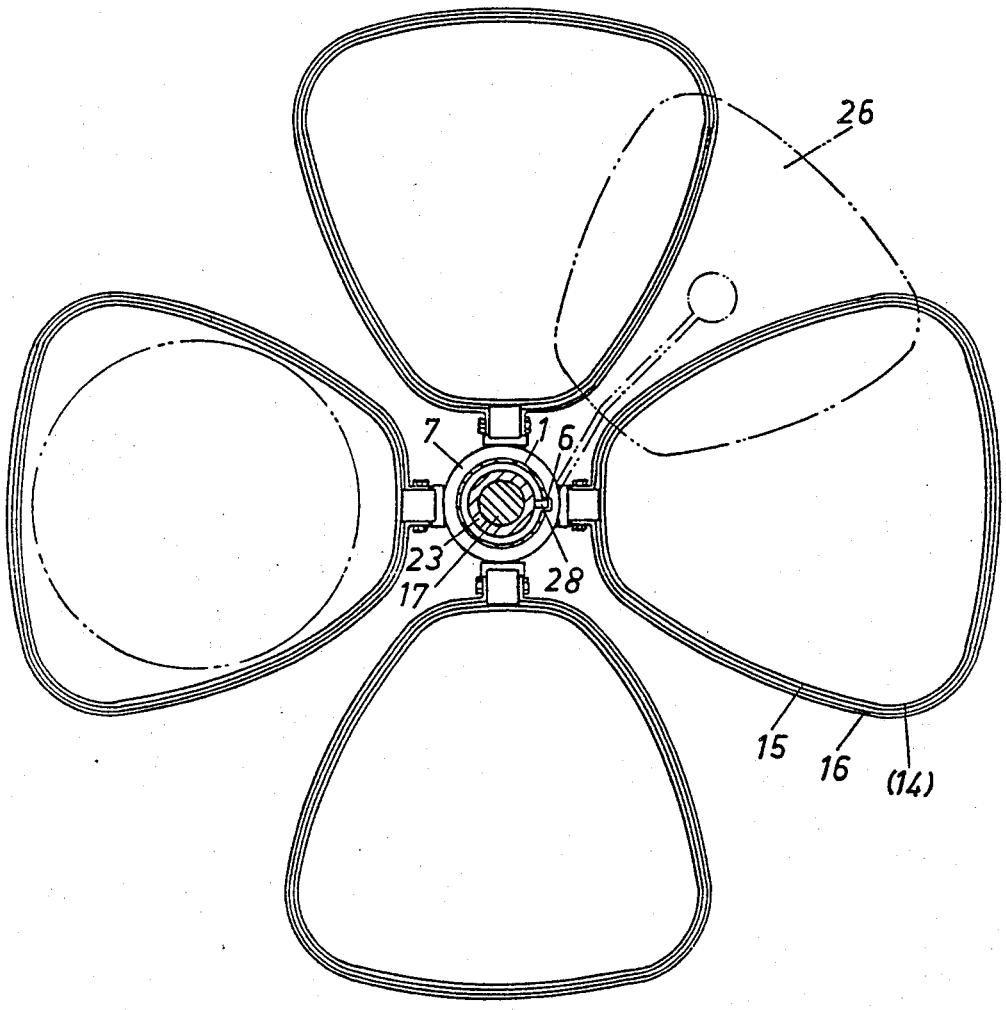
FIG. 2 is a sectional view along line II—II of FIG. 1.

The device in accordance with the subject invention comprises a vertical, fixedly mounted tube 1 which has longitudinally extending slots therein and is securely anchored between the floor 4 and the ceiling 5 of a room by means of a clamping means 2 at the lower tube end and anchoring pins 3 at the upper tube end. A sleeve 7 which is formed with internal guide tracks 6 is arranged about the lower part of the tube 1 and serves as an attachment to which bag holders 8 may be secured. In accordance with the illustrated embodiment four such bag holders are provided. Spaced about the sleeve 7 and securely anchored thereto are four dead end sleeves 9 of preferably square or rectangular cross-sectional shape. At the bottom, a platform 11 is arranged supporting bags 10 suspended in the holders 8. A compression spring 12 is positioned inside each dead end sleeve 9 in abutting and resilient relationship with a rod 13 which is telescopically displaceable in its respective sleeve. The upper ends of the rods 13 form attachments to which garbage bag holder frames 14 may be secured, each such frame consisting in a manner known per se of a support frame section 15 and a locking frame section 16 (see FIG. 2) clampingly securing a garbage bag 10 between them.

Inside the centre tube 1 is arranged a vertical, threaded spindle 17 the upper end of which is mounted in a transmission housing 18. Each spindle end is mounted in a thrust bearing 19. Spaced below the upper end 20 of the spindle 17 the latter is formed with a seat 21 on which a gear wheel 22 is arranged. Below the seat, the spindle 17 is provided with a sleeve 23 having internal threads 24 therein. The sleeve 23 is connected to a compacting plate 26 via an arm 25 which projects through a longitudinal slot 27 in the tube 1. The slot 27 is positioned so as to ensure that the compacting plate 26 assumes its non-operative position when located mid-way between and above two garbage bags 10. At its lower end the inner sleeve 23 is provided with a guide pin 28 which likewise projects through the slot 27 and engages in one of the internal groove tracks 6 of the outer sleeve 7.

When the spindle 17 starts to rotate in one direction, it urges the inner sleeve 23 to move axially downwards. The process thus initiated will be described in the following with reference to FIG. 3 which by way of example illustrates one design of the guide tracks 6. Letters A through F indicate the various positions that the guide pin 28 assumes and that cause rotation of the outer sleeve 7 and therefore of the garbage bag holders 8. For instance letter A indicates the starting or resting position assumed by a bag 10 beneath a refuse chute indicated in dash-and-dot lines and in which position the compacting plate 26 is above and half-way between two garbage bags. When the inner sleeve 23 starts its downward movement, the guide pin 28 moves from position A to position B. At this point begins the rotation of the outer sleeve 7. This rotation continues until the guide pin has reached position C inside the track 6, which position because of the rotation of the sleeve 7, in reality lies directly below position B and wherein the compacting plate 26 is located directly above a bag 10. Upon continued displacement to position D, the compacting plate 26 is lowered into the bag 10, compressing the garbage contained therein.

The spindle 17 is now stopped and made to rotate in the opposite direction, whereby the inner sleeve 23 turns in the opposite direction and the guide pin 28 moves from position D to position E. At this stage, the compacting plate 26 has reached its position above the bag 10. Upon its continued displacement from position E to position F the guide pin 28 urges the outer sleeve 7 to rotate over the same distance and in the same direction as during the initial rotation caused by the displacement of the guide pin from position B to position C. In the embodiment just described this means that the outer sleeve 7 and thus all the garbage bags 10 now have been displaced over a quarter of a circle.

The rotational movement of the spindle 17 is effected by an electric motor 29 which via a drive chain 30 is coupled to the gear wheel 22. On the drive shaft 31 of the motor is arranged a coupling 32 which, upon a pre-determined torque, disengages and emits a signal to a switch that the compacting plate 26 has reached the desired compacting pressure, whereupon the switch 33 effects reversion of the rotational direction of the motor 29.

a sensor 34 is arranged above a garbage bag or receiver 10 to sense the degree of fullness thereof. When garbage or other refuse falls from the chute 36 toward the bag 10, it strikes the sensor 34 which extends across the mouth of the bag 10 which at that moment is indexed to a position beneath the chute. The sensor 34 is deflected by the refuse downwardly or laterally, thus allowing the refuse to enter the bag 10. After deflection, the sensor 34 returns to a normal horizontal position. When the bag 10 is completely filled or filled to such a degree that the next oncoming refuse mass will retain the sensor 34 in a deflected position, not shown in the drawings, the sensor will emit a signal to initiate indexing of the platform 11 which takes place following a time delay of only a few seconds. The signal emitted by the sensor 34 starts up the motor 29 and the above-described operation is initiated.

A second switch 35 is located on the arm 25 of the compacting plate 26 and indicates when the compacting plate should stop in its upper position.

When each bag 10 is indexed and filled up in the described manner and with the motor 29 in operation, the compacting plate 26 then begins to move downwards, the stand turns over half its rotational path (45°), as described above, and the compacting plate continues to move downwards inside another bag 10 that at this stage is located directly beneath the compacting plate. The bag holder 8 takes part in this movement and pushes its rod 13 telescopically into the associated dead end sleeve 9 while compressing the spring 12. When the rotational movement of the motor 29 is reversed and the compacting plate 26 again rises, the bag-holder 8 springs back upwards. During the latter part of the process, before the switch 35 interrupts the current supply to the motor 29, the stand turns over the remaining half rotational path (45°), and a fresh garbage bag 10 assumes its position directly beneath the refuse chute 36.

The embodiment of the device in accordance with the subject invention described above has been chosen to illustrate the advantages gained by the inventive object. The structure is a compact one in that the components incorporated therein are arranged for mutual co-operation, one in the other. In the case illustrated the required structural height of the garbage bag stand therefore is very low. Only one motor is required to effect the turning of the stand as well as the compacting of the garbage. The structure is simple and the device consequently very reliable in operation. All working operations are automatic until all the garbage bags are full. Every change in the process, i.e. starting, stopping and transition from one operation to the next, takes place evenly and smoothly. The movements are performed rapidly, yet gently and without damage to the mechanical parts.

The invention is not limited to the embodiment in accordance with the application described but could be utilized e.g. in industrial robots in a variety of fields.

Figure 3:
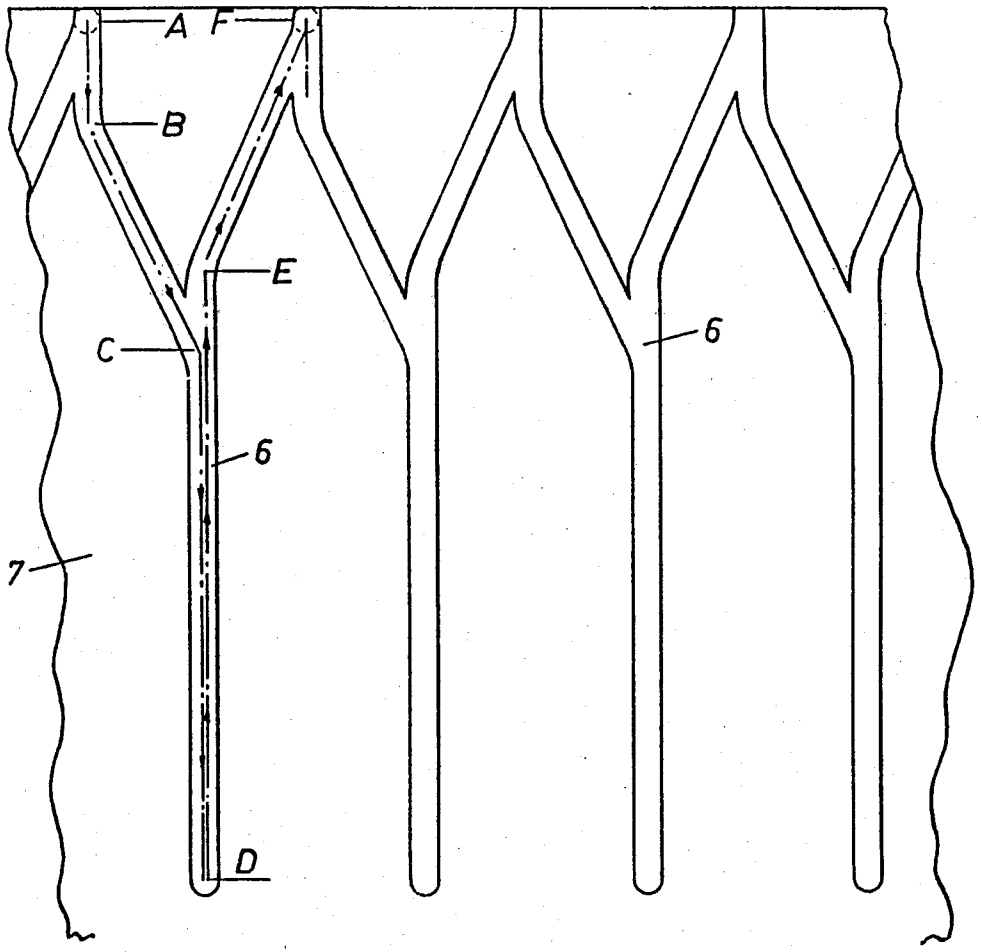
FIG. 3 shows a sleeve incorporated in the device in a flat, extended view, showing the internal guide tracks therein.
Figure 4:
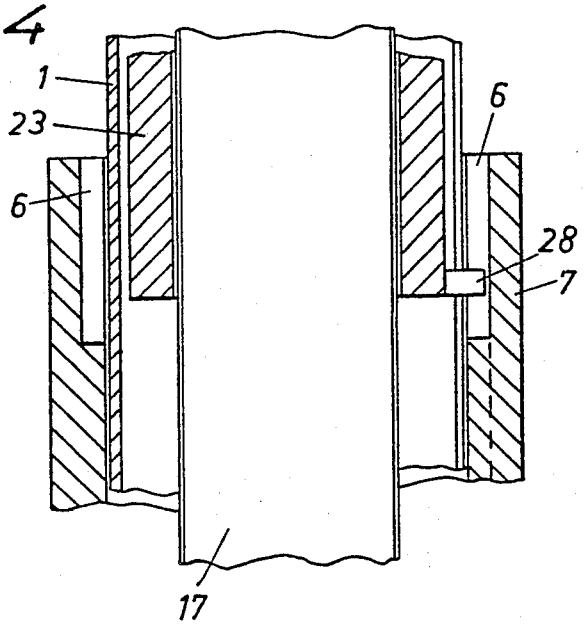
FIG. 4 shows on an enlarged scale the centre portion of the device of FIG. 1.
Figure 5:
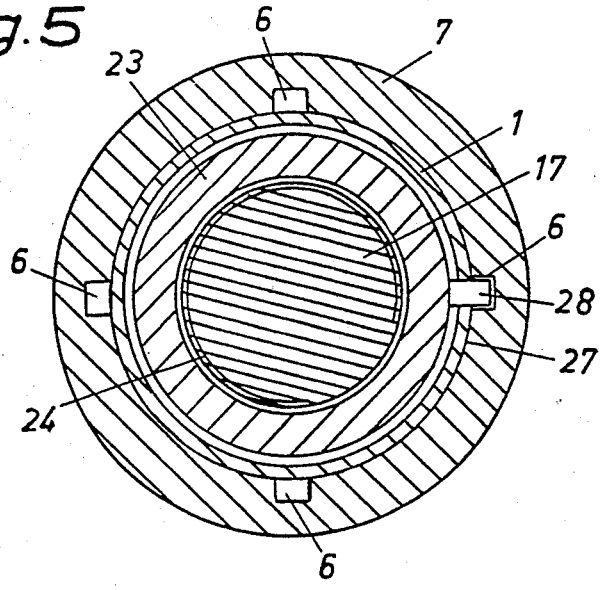
FIG. 5 is a horizontal section through the portion of FIG. 4.
Figure 6:
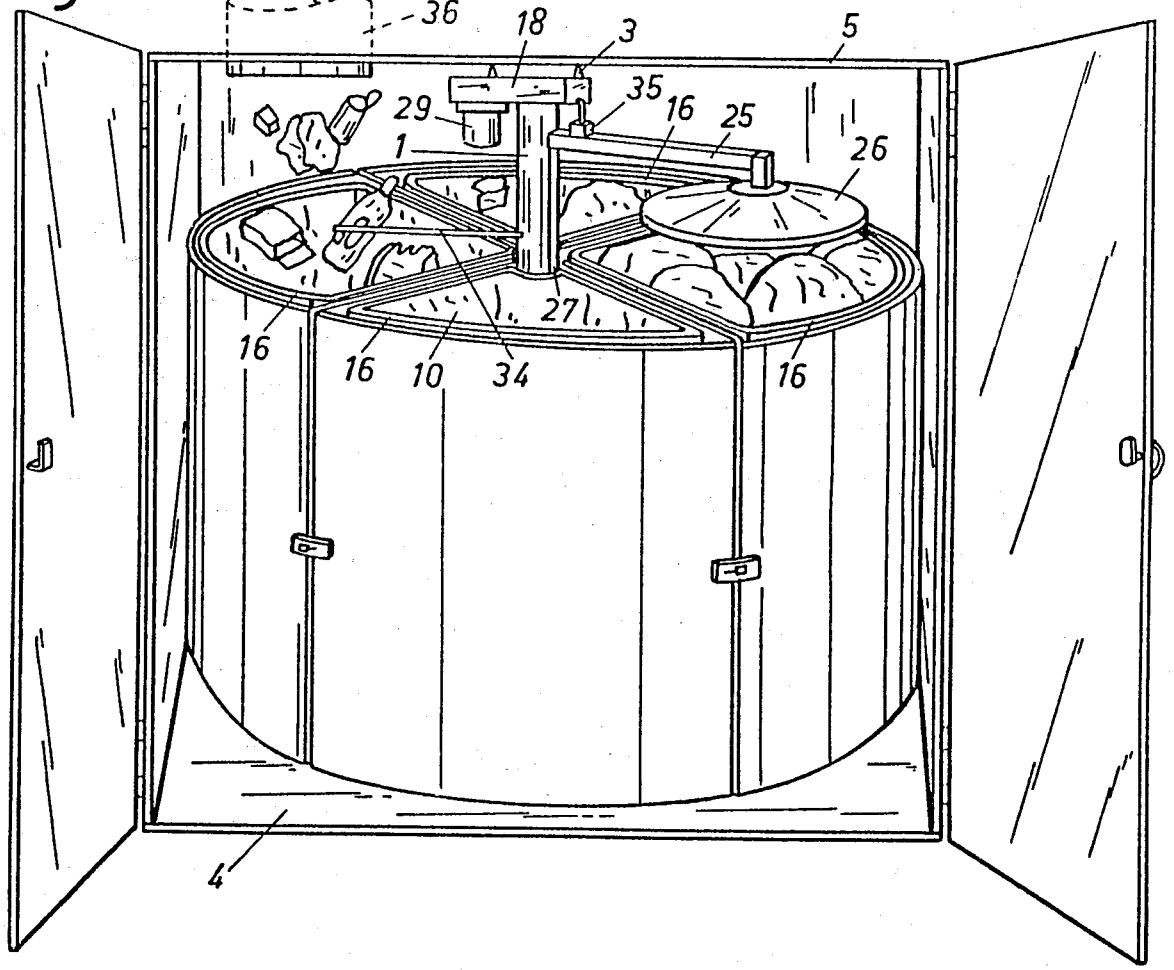
FIG. 6 is a perspective view of the garbage bag stand.

Naturally the guide tracks 6 could have a different curvature pattern than the one shown in FIG. 3. For instance, it is quite possible to replace the sleeve 7 in a machine by another sleeve having a different curvature pattern and in this manner operative members incorporated in one and the same machine could be made to perform different working operations.

What I claim is:

1. A device for producing complex relative movements in at least two different planes between working members of the device, comprising a rotatable sleeve secured to one working member, said rotatable sleeve having internal complex movement guide tracks arranged in a repetitive cycle according to a predetermined programmed pattern of relative movements for said working members, a coacting non-rotatable element mounted for axial displacement inside of the sleeve and being elongated and secured to a second working member of the device, a transversely projecting part on said non-rotatable element engaging within the internal guide tracks of said rotatable sleeve, and a driver for said non-rotatable element within said rotatable sleeve causing it to move axially of the sleeve in a direction to move the second working member of the device longitudinally of the sleeve toward a work performing position, and during such movement the engagement of said projecting part in one of said internal guide tracks producing rotation of the sleeve on its axis to impart rotation to said first working member relative to the second working member in a repetitive cycle of operation.

2. A device for producing complex relative movements as defined in claim 1 wherein said coacting non-rotatable element is an inner sleeve arranged for axial displacement in said rotatable sleeve and being provided with internal screw-threads, and a rotatable threaded spindle extending through and engaged with the threads of said inner sleeve and forming said driver, said inner sleeve arranged for axial movement on said threaded spindle.

3. A device for producing complex relative movements in at least two different planes between working members of the device, comprising a rotatable outer sleeve secured to one working member of the device and having internal guide tracks formed in repetitive convergent-divergent paths with corresponding junctures of said paths communicating with elongated parallel dwell portions of the guide tracks, a non-rotatable internally scerw-threaded inner sleeve secured to a second working member of the device extending away from the inner sleeve, the inner sleeve being mounted telescopically within said rotatable outer sleeve for axial displacement therein, a tube coaxially surrounding said non-rotatable internally screw-threaded inner sleeve and being fixed relative to the inner sleeve and rotatable outer sleeve and having a longitudinal slot, a part of said second working member engaging said slot to restrain rotation of said inner sleeve, a transversely projecting element on said inner sleeve engaging cammingly within said guide tracks, the guide tracks forming a continuous track path including said convergent-divergent paths and said parallel dwell portions, and a rotatable screw-threaded spindle engaged threadedly with the screw-threads of said inner sleeve and operable to drive the inner sleeve axially with relation to the rotatable outer sleeve, whereby said transversely projecting element on the inner sleeve cammingly drives the rotatable outer sleeve through a rotational cyclic movement path determined by said continuous track path.

4. A device as defined in claim 3, wherein the device comprises a refuse collection and compacting device including plural refuse receivers surrounding said rotatable outer sleeve and being carried by said one working member, and the second working member comprising a refuse compacting plate including an arm extending radially of said inner sleeve and secured to the inner sleeve and engaging through said longitudinal slot of said tube.

5. A device as defined in claim 3, and a motor operatively coupled to said spindle to rotate the spindle, a torque limiting coupling conected between the drive shaft of said motor and said spindle, and a reversing switch for said motor to cause reversal of the motor drive shaft and reverse rotation of said spindle when a predetermined torque is exceeded.

6. A device as defined in claim 5, and a sensing means positioned to sense the degree of filling of each refuse receiver and responding to a predetermined degree of filling of each receiver by emitting a signal to start said motor.

7. A device as defined in claim 4, and plural circumferentially spaced dead end sleeves secured to and surrounding the rotatable outer sleeve and corresponding in number to said refuse receivers, rods forming parts of said receivers engaging telescopically in said dead end sleeves, and compression springs in said dead end sleeves beneath said rods.

8. A device as defined in claim 7, and said receivers comprising refuse bags, and bag holders carried by the upper ends of said rods.

* * * * *